United States Patent [19]

Hamashima et al.

[11] Patent Number: 4,671,822

[45] Date of Patent: Jun. 9, 1987

[54] $ZRB_2$-CONTAINING SINTERED CERMET

[75] Inventors: Kazuo Hamashima; Makoto Imakawa, both of Yokohama; Yukinori Kutsukake, Tokyo, all of Japan

[73] Assignee: Asahi Glass Company, Ltd., Tokyo, Japan

[21] Appl. No.: 870,747

[22] Filed: Jun. 4, 1986

[30] Foreign Application Priority Data

Jun. 19, 1985 [JP] Japan ..... 60-131673

[51] Int. Cl.[4] ..... C22C 29/14

[52] U.S. Cl. ..... 75/244; 419/12; 419/23; 419/34; 419/45; 501/96; 501/98

[58] Field of Search ..... 419/12, 23, 34, 45; 75/244; 501/96, 98

[56] References Cited

U.S. PATENT DOCUMENTS

| | | | |
|---|---|---|---|
| 2,936,250 | 5/1960 | Glaser | 419/12 |
| 3,937,619 | 2/1976 | Clougherty | 419/12 |
| 4,246,027 | 1/1981 | Watanabe et al. | 419/12 |
| 4,268,582 | 5/1981 | Hale et al. | 419/12 |
| 4,450,135 | 5/1984 | Peters et al. | 419/12 |

FOREIGN PATENT DOCUMENTS

| | | |
|---|---|---|
| 51-30213 | 4/1976 | Japan . |
| 58-37275 | 3/1983 | Japan . |
| 747483 | 4/1956 | United Kingdom . |
| 899970 | 6/1962 | United Kingdom . |
| 990316 | 4/1965 | United Kingdom . |
| 996970 | 6/1965 | United Kingdom . |
| 1277281 | 6/1972 | United Kingdom . |
| 1558068 | 12/1979 | United Kingdom . |

*Primary Examiner*—Stephen J. Lechert, Jr.

*Attorney, Agent, or Firm*—Oblon, Fisher, Spivak, McClelland & Maier

[57] ABSTRACT

A $ZrB_2$-containing sintered cermet comprising zirconium diboride partially substituted by at least one member selected from the group consisting of chromium boride, molybdenum boride and tungsten boride, and a binding component containing at least one member selected from the group consisting of metals of Group VIII of the periodic table.

11 Claims, No Drawings

$ZRB_2$-CONTAINING SINTERED CERMET

The present invention relates to a $ZrB_2$-containing sintered cermet, and particularly to a zirconium diboride-containing sintered cermet having excellent strength, toughness, hardness and oxidation resistance. More particularly, it relates to a zirconium diboride-containing sintered cermet having particularly excellent toughness. The sintered cermet of the present invention is a material having a high density, high strength, high toughness and particularly excellent oxidation resistance, and thus is suitable for cutting tools, machine structural materials, etc. Further, it is by nature superior in the corrosion resistance, high melting point and electric conductivity. Thus, it finds a wide range of applications, for instance, as heat resistant and anticorrosion materials, heater elements, electrodes, etc.

In general, metal boride ceramics are characterized by a high melting point, high hardness, high strength and high corrosion resistance, and they have been practically used as materials for cutting tools or the like. Particularly, titanium boride is widely used. However, zirconium boride has rarely been practically used.

Further, composites of these borides with metals, i.e. boride-type cermets, have been practically used to some extent, and various proposals have been made for practical applications.

For instance, as such a boride-type cermet, a sintered product is known wherein an iron-group metal or an intermetallic compound containing an iron-group metal is used as a binder, and such a sintered product is believed to be useful as a cutting tool, a machine part or an accessary such as a frame for a watch, and such an attempt is being made. Namely, Japanese Unexamined Patent Publication No. 30213/1976 discloses that excellent mechanical properties, interfacial properties and corrosion resistance, abrasion resistance or heat resistance and oxidation resistance are obtainable by using an iron-group metal or an alloy containing an iron-group metal as the binder for a borate. Further, Japanese Examined Patent Publicaiton No. 37275/1983 discloses that a suitable temperature range for sintering can be widened by using a silicide as a binder.

However, binders disclosed in these references are generally poor in the ductility, and therefore the toughness of the sintered product is low. Even when it is suggested to use an iron-group metal, such a suggestion is intended for a structure to form an intermetallic compound, whereby no adequate effects are obtainable in e.g. the toughness.

With respect to zirconium diboride, there have been little practical proposals to solve these problems.

Under these circumstances, the present inventors have conducted various researches to develop a zirconium diboride sintered product having the desired high level of toughness as well as high strength, and have finally accomplished the present invention.

Namely, the present inventors have found a binder which overcomes the above-mentioned drawback and yet permits zirconium diboride to provide the useful properties. Specifically, they have succeeded in developing a binder component composed of an iron-group metal in which silicone and/or aluminum is solid solubilized, and a binder component composed of an iron-group metal in which tungsten and/or molybdenum is solid-solubilized. Such a development is fairly effective by itself. On the other hand, however, it has been desired to further improve the strength and hardness so that the sintered product can be useful under severe conditions. The present inventors have conducted further researches in view of this desirability, and have found it possible to further improve the hardness and the strength of the sintered product.

Thus, the present invention provides a $ZrB_2$-containing sintered cermet comprising zirconium diboride partially substituted by at least one member selected from the group consisting of chromium boride, molybdenum boride and tungsten boride; and a binding component containing at least one member selected from the group consisting of metals of Group VIII of the periodic table. The $ZrB_2$-containing sintered cermet of the present invention is characterized by its high density and high strength.

Now, the present invention will be described in detail with reference to the preferred embodiments.

$ZrB_2$ to be used in the present invention can be obtained, for example, by reacting a mixture of zirconium oxide, boron carbide and carbon at a high temperature. For the production of the sintered cermet of the present invention, it is desirable to employ $ZrB_2$ having a purity as high as possible. Likewise, the particle size of the powder is preferably as small as possible. Specifically, the purity is preferably at least 99% by weight, and the mean particle size is preferably at most 10 $\mu$m, more preferably at most 1 $\mu$m.

The metals of Group VIII of the periodic table used for the binder which forms the binder component whereby $ZrB_2$ can densely be sintered as the cermet of the present invention, are preferably iron-group metals. Such iron-group metals are used preferably in a fine powder form from the beginning as starting material in order to avoid oxidation of the powder during the pulverization or to prevent inclusion of impurities due to the abrasion of the milling pot. For instance, a powder obtained by a carbonyl powder method having a purity of at least 99.5% by weight and a mean particle size of about 1.5 $\mu$m, is preferred. The carbon content is preferably not higher than 0.1% by weight.

Likewise, chromium boride, molybdenum boride and tungsten boride to be substituted for a part of zirconium diboride, are desired to have a purity as high as possible and to be a powder having a particle size as small as possible. Particularly preferred are those having minimum carbon and oxygen contents. Specifically, the purity is preferably at least 99% by weight, and the mean particle size is preferably at most 10 $\mu$m.

In order to obtain the $ZrB_2$-containing sintered cermet of the present invention, the predetermined amounts of the above-mentioned powders are mixed, and the powder mixture thus obtained is pressed by e.g. a die press to obtain a pressed powder body, which is then heated in a neutral atmosphere such as argon or hydrogen, or in vacuum, or in a reducing atmosphere, by pressureless sintering at a temperature of at least 1200° C., in most cases, within a temperature range of from 1400° to 1700° C. Otherwise, such a sintered cermet can be prepared by filling the powder mixture into a graphite mold and hot-pressing it in a similar atmosphere (under a pressure of at least 20 kg/cm$^2$, preferably from 300 to 400 kg/cm$^2$) under heating at a temperature of at least 1000° C., in most cases within a temperature range of from 1100° to 1500° C. When the same material is used, it is usual that the one obtained by hot-pressing exhibits superior performance. However, even when obtained by pressureless sintering, the sintered cermet of the present invention provides superior performance as compared with the conventional products. Of course, the hot-pressed product is superior to the conventional products in the performance. Thus, the sintered cermet of the present invention comprises a boride component consisting essentially of $ZrB_2$ partially substituted by chromium boride and/or molybdenum boride and/or tungsten boride, and a binding component for the boride component, containing at least one member selected from the group consisting of iron-group metals. With respect to the proportions of such boride component and binding component in the sintered cermet, the boride component is usually from 30 to 95% by weight, preferably from 40 to 90% by weight, and the binding component is usually from 5 to 70% by weight, preferably from 10 to 60% by weight.

If the proportion of the binding component is too small, it is difficult to obtain a dense sintered cermet. On the other hand, if it is too large, the heat resistance tends to deteriorate, or the deformation during sintering tends to be substantial, such being undesirable.

The weight ratio of the chromium borate and/or the molybdenum borate and/or tungsten borate in the total amount with $ZrB_2$, is from 3 to 55%. Preferably, the chromium boride is in an amount of from 3 to 30% by weight as CrB, the molybdenum boride is in an amount of from 8 to 45% by weight as MoB, and the tungsten boride is in an amount of from 12 to 50% by weight as WB, each in the total amount with $ZrB_2$.

If $ZrB_2$ is substituted too much, the relative density of the sintered cermet tends to be low, such being undesirable. On the other hand, if the amount of substitution is inadequate, no substantial effects for the improvement of the strength and hardness of the sintered cermet will be obtained.

In particular, if the chromium boride exceeds 30% by weight, a brittle layer is likely to partially form, whereby the sintered cermet tends to be brittle. If the molybdenum boride is less than 8% by weight, no substantial effects for the improvement of the strength and hardness of the sintered cermet will be obtained. On the other hand, if the amount exceeds 45% by weight, densification will hardly be obtained, whereby the relative density of the sintered cermet tends to be low. Further, if the tungsten boride is less than 12% by weight, it is difficult to improve the hardness and strength of the sintered cermet, and if the amount exceeds 50% by weight, the number of pores in the sintered cermet tends to increase, whereby the hardness and strength rather tends to decrease.

In the sintered cermet of the present invention, chromium boride is usually present in the form of CrB in its majority, but a part of it may be present in the form of $CrB_2$ or $Cr_2B$. Likewise, molybdenum boride is usually present in the form of MoB in its majority, but a part of it may be present in the form of $Mo_2B$ or $Mo_2B_5$. Similarly, tungsten boride is usually present in the form of WB in its majority, but a part of it may be present in the form $W_2B$ or $W_2B_5$.

The iron-group metals as the metals of Group VIII of the periodic table which form the binding component in the sintered cermet of the present invention, include iron (Fe), cobalt (Co) and nickel (Ni). Each of these iron-group metals may be employed.

Here, these metals provide substantially the same effects for the purpose of the present invention. However, Fe is most suitable, e.g. for the reason that it hardly forms a reaction product with e.g. $ZrB_2$. On the other hand, depending upon the particular purpose for acid- and corrosion-resistant material, Co may be most suitable.

With respect to these metals, the preferred ranges are as follows. Namely, Fe is from 10 to 60% by weight, Co is from 10 to 40% by weight, and Ni is from 10 to 40% by weight, based on the total weight of the sintered cermet.

Further, in some cases, it is desirable for the improvement of the strength of the binding component to incorporate small amounts of other metals to the binding component composed of such iron-group metals. As specific metals desirable for such purpose, there may be mentioned at least molybdenum (Mo) and tungsten (W).

Namely, if Mo and W are incorporated in small amounts within a range such that they are solid-solubilized in the iron-group metals, the binding component can be reinforced, and the improvement in the strength and hardness of the sintered cermet can be ensured. The preferred ranges are as follows. (by weight)

In the case where iron is used as the binder (in the total amount with Fe):

$0.8\% \leqq Mo \leqq 8\%$, particularly $1.7\% \leqq Mo \leqq 7\%$, and/or
$0.5\% \leqq W \leqq 5\%$, particularly $1.5\% \leqq W \leqq 4.5\%$.

In the case where nickel is used as the binder (in the total amount with Ni):

$0.5\% \leqq Mo \leqq 20\%$, particularly $3\% \leqq Mo \leqq 1.5\%$, and/or
$0.5\% \leqq W \leqq 29\%$, particularly $1\% \leqq W \leqq 20\%$.

In the case where cobalt is used as the binder (in the total amount with Co):

$0.5\% \leqq Mo \leqq 10\%$, particularly $2\% \leqq Mo \leqq 8\%$, and/or
$0.5\% \leqq W \leqq 10\%$, particularly $2\% \leqq W \leqq 8\%$.

These ranges are determined on the basis of the minimum amount for providing the effectiveness of the addition and the maximum amount not to form a brittle layer in the binding component.

Thus, the sintered cermet of the present invention comprises $ZrB_2$ as the main component, and prescribed amounts of at least one of the CrB, MoB and WB and at least one metal of Group VIII as essential components, but small amounts of other components may be contained to the extent that the desired properties and the purpose of the present invention are not impaired. However, it is preferred that the amounts of such additional components are as small as possible.

In the structure of such a sintered cermet of the present invention, $ZrB_2$ constitutes the main crystals (hexagonal), and a part thereof is substituted by CrB and/or MoB and/or WB crystals of different types (tetragonal or rhombic). However, some crystals of CrB and/or MoB and/or WB interact metal, and these interacted crystals and $ZrB_2$ crystals can diffuse mutually at high temperature. In consequence, boundary strength of $ZrB_2$ crystal and binding layer is reinforced by these reaction. A metal layer containing at least one type of iron-group metals as an essential element for the binding component is present in the form of tree branches among such crystals to establish a dense and firm bondage. More specifically, $ZrB_2$ crystals are present in the form of extremely fine crystals, i.e. the majority of the crystals have a particle size of not higher than 5 μm. Likewise, CrB, MoB and WB are present in a fine particle form of not larger than 10 μm. The metal has a thickness of from 2 to 3 μm, and constitutes a continuous layer.

Now, the present invention will be described in further detail with reference to Examples. However, it should be understood that the present invention is by no means restricted by these specific Examples.

EXAMPLE 1

By using ethanol, 48 parts by weight of $ZrB_2$ powder (purity: 99.5%, mean particle size: 6.4 μm), 20 parts by weight of WB powder (purity: 99.5%, mean particle size: 4.8 μm), 30.3 parts by weight of iron powder (purity: 99.6%, mean particle size: 1 μm) and 1.7 part by weight of tungsten powder (purity: 99.0%, mean particle size: 1 μm) were pulverized and mixed for 24 hours in $ZrB_2$ cermet balls. The powder mixture was vacuum-dried, then placed in a graphite mold having a diameter of 60 mm, and heated in argon at 1270° C. for 30 minutes under a pressure of 350 kg/cm$^2$. The sintered cermet thus obtained and having a diameter of 60 mm and a height of 15 mm, had a bending strength of 148 kg/mm$^2$ at room temperature (174 kg/mm$^2$ at 800° C.), a fracture toughness $K_{1C}$=9.5 MN/m$^{3/2}$ (chevron notch method, notch angle $\theta$=90°), a vickers hardness of 1280 kg/mm$^2$ at room temperature and a relative density of 99.97%. Thus, it was excellent without pores.

EXAMPLE 2

A powder mixture having the same composition as in Example 1 was mixed, pulverized and dried in the same manner as in Example 1, and then subjected to die pressing and further to hydraulic pressing, followed by heating in vacuum at 1600° C. for 2 hours to obtain a sintered cermet of 30×50×20 mm$^3$ under a pressureless condition. This sintered cermet had a bending strength of 98 kg/mm$^2$ at room temperature (115 kg/mm$^2$ at 800° C.), $K_{1C}$=9.2 MN/m$^{3/2}$, a vickers hardness of 950 kg/mm$^2$ at room temperature and a relative density of 99.91%.

EXAMPLES 3 to 27 and COMPARATIVE EXAMPLES 1 to 6

Sintered cermets were prepared in the same manner as in Example 1 except for the conditions identified in Table 1. The properties of the sintered cermets thereby obtained are shown in Table 1.

TABLE 1

| | Composition of starting materials* (parts by weight) | Sintering conditions | | | Properties of sintered cermet | | | | |
|---|---|---|---|---|---|---|---|---|---|
| | | Temp. (°C.) | Pressure** (kg/cm$^2$) | Atmosphere | Bending strength (kg/mm$^2$) Room temp. | Bending strength (kg/mm$^2$) 800° C. | Fracture toughness $K_{1C}$MN/m$^{3/2}$ | Vickers hardness (at room temp.) (kg/mm$^2$) | Relative density (%) |
| Example No. | | | | | | | | | |
| 3 | 20WB—11Fe | 1450 | 350 | Ar | 133 | 141 | 8.1 | 1430 | 99.35 |
| 4 | 20WB—33Fe | 1350 | 350 | " | 135 | 145 | 9.5 | 1350 | 99.80 |
| 5 | 6CrB—38.6Co | 1300 | 350 | " | 135 | 148 | 8.8 | 1380 | 99.85 |
| 6 | 13.5MoB—13.4Co | 1400 | 350 | " | 130 | 143 | 7.9 | 1480 | 99.20 |
| 7 | 10WB—7.7CrB—51.2Co | 1230 | 350 | " | 148 | 135 | 9.3 | 1150 | 99.90 |
| 8 | 10WB—48Ni | 1250 | 350 | " | 145 | 140 | 9.4 | 1100 | 99.75 |
| 9 | 12.5MoB—37Ni | 1300 | 350 | " | 140 | 142 | 9.1 | 1310 | 99.85 |
| 10 | 11.4WB—6.3MoB—12.7Ni | 1430 | 350 | " | 131 | 138 | 8.0 | 1410 | 99.40 |
| 11 | 5WB—47.5Fe | 1550 | 0 | Vac. | 105 | 120 | 11.8 | 940 | 99.95 |
| 12 | 35WB—23.0Fe—1.2Mo | 1320 | 350 | Ar | 130 | 150 | 8.5 | 1450 | 99.85 |
| 13 | 20WB—21Fe—10Co—1.1W | 1250 | 350 | " | 140 | 155 | 9.0 | 1400 | 99.96 |
| 14 | 10WB—34Co—1.2W | 1450 | 0 | Vac. | 110 | 120 | 11.0 | 1050 | 99.90 |
| 15 | 13.7CrB—35.2Fe—1.8W | 1320 | 350 | Ar | 138 | 155 | 9.3 | 1440 | 99.80 |
| 16 | 38CrB—17.5Fe—1.0Mo | 1320 | 350 | " | 130 | 145 | 8.1 | 1580 | 99.80 |
| 17 | 7.3CrB—36Ni—0.8W | 1450 | 0 | Vac. | 112 | 126 | 9.8 | 1350 | 99.90 |
| 18 | 13.7CrB—16Ni—16Co—0.8Mo | 1250 | 350 | Ar | 162 | 170 | 9.3 | 1480 | 99.88 |
| 19 | 12.5MoB—32.8Fe—1.8W | 1280 | 350 | " | 165 | 180 | 10.5 | 1320 | 99.95 |
| 20 | 20MoB—55Fe—2.6W | 1550 | 0 | Vac. | 121 | 130 | 11.8 | 890 | 99.95 |
| 21 | 7MoB—18Fe—12Ni—1.5Mo | 1280 | 350 | Ar | 145 | 160 | 9.8 | 1300 | 99.92 |
| 22 | 12MoB—12Fe—12Ni—12Co—1.1Mo | 1270 | 350 | " | 140 | 155 | 9.5 | 1370 | 99.88 |
| 23 | 10WB—13.7CrB—35Fe | 1300 | 350 | " | 175 | 190 | 8.4 | 1410 | 99.85 |
| 24 | 10WB—7.3CrB—7MoB—45Fe | 1320 | 350 | " | 180 | 180 | 8.1 | 1350 | 99.70 |
| 25 | 15CrB—15MoB—35Ni—1.3W | 1280 | 350 | " | 135 | 135 | 9.0 | 1320 | 99.50 |
| 26 | 15CrB—7.3MoB—23Co—0.8Mo | 1280 | 350 | " | 120 | 120 | 8.6 | 1370 | 99.60 |
| 27 | 10WB—13.7CrB—7.3MoB—15Fe—10Co | 1320 | 350 | " | 130 | 130 | 8.3 | 1330 | 99.40 |
| Comparative Example No. | | | | | | | | | |
| 1 | 47.5Fe | 1500 | 0 | Vac. | 54 | 40 | 7.3 | 730 | 95.0 |
| 2 | 24.4Fe—1.1W | 1400 | 350 | Ar | 90 | 110 | 8.6 | 1350 | 99.50 |
| 3 | 24.4Fe—1.1W | 1600 | 0 | Vac. | 74 | 92 | 8.5 | 1300 | 99.65 |
| 4 | 47.5Fe—2.1W | 1200 | 350 | Ar | 110 | 130 | 10.3 | 1000 | 99.85 |
| 5 | 35.0Ni—3.9Mo | 1200 | 350 | " | 105 | 120 | 9.8 | 1230 | 99.70 |
| 6 | 12.2Fe—12.2Ni—12.2Co—W | 1250 | 350 | " | 110 | 125 | 10.2 | 1240 | 99.75 |

*The rest, i.e. other than those indicated, are $ZrB_2$ and unavoidable impurities, and their amount is 100 parts by weight less the parts by weight of the indicated components.
**Pressure 0 under the sintering condition means pressureless sintering.

As is evident from the above Table, the sintered cermets of the present invention are electrically conductive $ZrB_2$ sintered cermets having particularly high toughness and bending strength as well as high density, high hardness and excellent oxidation resistance. They can provide the desirable properties as $ZrB_2$-containing sintered cermets, and they can be used in a wide range of applications, for instance, for cutting tools, machine parts, high temperature corrosion resistant parts, heating elements for electrodes. Thus, the industrial value of the present invention is substantial.

We claim:

1. A $ZrB_2$-containing sintered cermet comprising zirconium diboride partially substituted by at least one member selected from the group consisting of chromium boride, molybdenum boride and tungsten boride, and a binding component containing at least one member selected from the group consisting of metals of Group VIII of the periodic table.

2. The sintered cermet according to claim 1, wherein the binding component is from 5 to 70% by weight.

3. The sintered cermet according to claim 2, wherein the binding component is from 10 to 60% by weight.

4. The sintered cermet according to claim 1, wherein from 3 to 55% by weight of the zirconium diboride is substituted by at least one member selected from the group consisting of chromium boride, molybdenum boride and tungsten boride.

5. The sintered cermet according to claim 4, wherein the chromium boride is in an amount of from 3 to 30% by weight as CrB in the total amount with $ZrB_2$.

6. The sintered cermet according to claim 4, wherein the molybdenum boride is in an amount of from 8 to 45% by weight as MoB in the total amount with $ZrB_2$.

7. The sintered cermet according to claim 4, wherein the tungsten boride is in an amount of from 12 to 50% by weight as WB in the total amount with $ZrB_2$.

8. The sintered cermet according to claim 1, wherein the metals of Group VIII are iron-group metals.

9. The sintered cermet according to claim 8, wherein the iron-group metals are Fe, Co and Ni.

10. The sintered cermet according to claim 1, wherein the binding component is a metal of Group VIII containing molybdenum and/or tungsten as solid solution.

11. The sintered cermet according to claim 1, wherein a part of crystals of chromium boride, molybdenum boride and/or tungsten boride interacts the metal of the binding component, and the interacted crystals and crystals of zirconium diboride are mutually diffused in the binding component.

* * * * *